US007498913B2

(12) United States Patent
Kawamura et al.

(10) Patent No.: US 7,498,913 B2
(45) Date of Patent: Mar. 3, 2009

(54) THERMAL TRIP DEVICE AND CIRCUIT BREAKER USING THE SAME

(75) Inventors: Kouji Kawamura, Tokyo (JP); Hiroyuki Akita, Tokyo (JP); Masatoshi Murai, Tokyo (JP); Hirotoshi Yonezawa, Tokyo (JP); Satoru Naito, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 69 days.

(21) Appl. No.: 10/592,003

(22) PCT Filed: Apr. 21, 2004

(86) PCT No.: PCT/JP2004/005705

§ 371 (c)(1),
(2), (4) Date: Sep. 7, 2006

(87) PCT Pub. No.: WO2005/104159

PCT Pub. Date: Nov. 3, 2005

(65) Prior Publication Data

US 2007/0195478 A1 Aug. 23, 2007

(51) Int. Cl.
*H01H 51/00* (2006.01)
*H01H 61/00* (2006.01)

(52) U.S. Cl. ..... 335/145; 335/23; 335/31; 335/35; 335/37; 335/43; 335/66; 335/141; 361/26; 361/32; 361/34; 361/93.8; 361/103; 361/104; 361/105; 361/106; 361/124; 361/161; 361/162; 361/163; 361/164; 361/165

(58) Field of Classification Search ..... 335/23, 335/31–39, 43, 66, 141, 145; 361/26, 32, 361/34, 93.8, 103–106, 124, 161–165, 282, 361/704
See application file for complete search history.

(56) References Cited

U.S. PATENT DOCUMENTS

| | | | | |
|---|---|---|---|---|
| 3,261,947 | A * | 7/1966 | Brouwer | 337/76 |
| 4,106,482 | A * | 8/1978 | Savage et al. | 126/587 |
| 5,317,471 | A * | 5/1994 | Izoard et al. | 361/105 |
| 6,135,633 | A * | 10/2000 | DiMarco et al. | 374/1 |
| 6,215,379 | B1 * | 4/2001 | O'Keefe et al. | 335/35 |
| 6,246,241 | B1 * | 6/2001 | Newland | 324/424 |
| 6,466,424 | B1 * | 10/2002 | Larranaga et al. | 361/103 |
| 6,580,351 | B2 * | 6/2003 | Davis et al. | 337/111 |

(Continued)

FOREIGN PATENT DOCUMENTS

GB 1419528 A * 12/1975

(Continued)

*Primary Examiner*—Elvin G Enad
*Assistant Examiner*—Mohamad A Musleh
(74) *Attorney, Agent, or Firm*—Buchanan Ingersoll & Rooney PC

(57) ABSTRACT

A thermal trip device in which a bimetal (2) is heated by overcurrent and performs trip operation of a circuit by curvature of the heated bimetal (2), wherein at least one part of the surface of the bimetal (2) is made to be black or matte black (7). Thereby, temperature of the bimetal (2) can be highly accurately measured using a no-contact thermometer. Furthermore, a temperature measurement part (8) of the bimetal is provided with a bending part (11), and the surface of the bending part is made to be matte black.

3 Claims, 5 Drawing Sheets

U.S. PATENT DOCUMENTS 6,803,850 B2 * 10/2004 Richter ..... 337/107
6,816,055 B2 * 11/2004 Weber ..... 337/82
7,135,953 B2 * 11/2006 Leitl et al. ..... 337/84
7,279,218 B2 * 10/2007 Watase et al. ..... 428/212
2003/0043522 A1 * 3/2003 Schmalz ..... 361/105
2007/0165349 A1 * 7/2007 Parker ..... 361/103

FOREIGN PATENT DOCUMENTS

JP 11219645 A * 8/1999
JP 2002-245919 8/2002
JP 2002-324473 11/2002

* cited by examiner

THERMAL TRIP DEVICE AND CIRCUIT BREAKER USING THE SAME

TECHNICAL FIELD

The present invention relates to a thermal trip device and a circuit breaker using the same.

BACKGROUND ART

A thermal trip device is, for example, a device that detects overcurrent in a circuit breaker to trip a main circuit. Trip characteristic when overcurrent flows has its range stipulated by standard such as JIS (Japanese Industrial Standard) and products need to comply with it. In a thermal trip device, however, variation in trip characteristic is inevitable due to manufacturing variation of constitutional components and material variation. Consequently, a structure for adjusting the trip characteristic is usually incorporated to adjust and inspect the characteristic.

In order to adjust and inspect the trip characteristic, its characteristic value needs to be accurately measured. In the thermal trip device, the trip characteristic is often measured by measuring a time (trip time) from energization initiation to trip completion and an amount of displacement of a bimetal by supplying a predetermined current. Meanwhile, curvature factor of a bimetal is known and therefore the amount of displacement of the bimetal can be determined by measuring a bimetal temperature. Therefore, the trip characteristic can be figured out by measuring the bimetal temperature.

When measuring the bimetal temperature, a method of no-contact measurement is preferable in order not to affect on an amount of curvature of the bimetal by measurement. In measurement by a contact thermometer, load is applied to a bimetal from outside via a probe and therefore deflection is generated in the bimetal to cause change in trip characteristic. As for a method of no-contact temperature measurement, an emission thermometer incorporating an infrared absorption element is commonly used.

However, there is a problem in that a usual bimetal surface is a metallic luster surface and therefore accurate temperature measurement is difficult. Furthermore, in an electric leakage circuit breaker incorporating an electric leakage detection circuit and a circuit breaker reduced in size, it is difficult to measure a temperature of the bimetallic surface from outside because of having fewer clearances around the bimetal.

The present invention is implemented to solve such problems, and an object of the present invention is to provide a thermal trip device and a circuit breaker using the same, capable of highly accurately measuring a bimetal temperature using a no-contact thermometer.

DISCLOSURE OF THE INVENTION

According to the present invention, there is provided a thermal trip device in which a bimetal is heated by overcurrent and performs trip operation of a circuit by curvature of the heated bimetal, wherein at least one part of the surface of the bimetal is made to be black or matte black.

Thereby, temperature of the bimetal can be highly accurately measured using a no-contact thermometer.

Furthermore, according to the present invention, the surface of a temperature measurement part of the bimetal is made to be black or matte black.

Furthermore, according to the present invention, the temperature measurement part of the bimetal is provided with a bending part bent substantially perpendicular to longitudinal direction, and the surface of the bending part is made to be black or matte black.

Thereby, even models in which measurement from substantially vertical direction of the bimetallic surface is difficult, it is possible to stably perform temperature measurement with high accuracy.

Furthermore, according to the present invention, a temperature measurement part of the bimetal is provided with a bending part bent substantially perpendicular to longitudinal direction.

Thereby, measurement from substantially vertical direction of the bimetal can be made and it is possible to stably perform temperature measurement with high accuracy.

BEST MODE FOR CARRYING OUT THE INVENTION

First Embodiment

Figure 9:
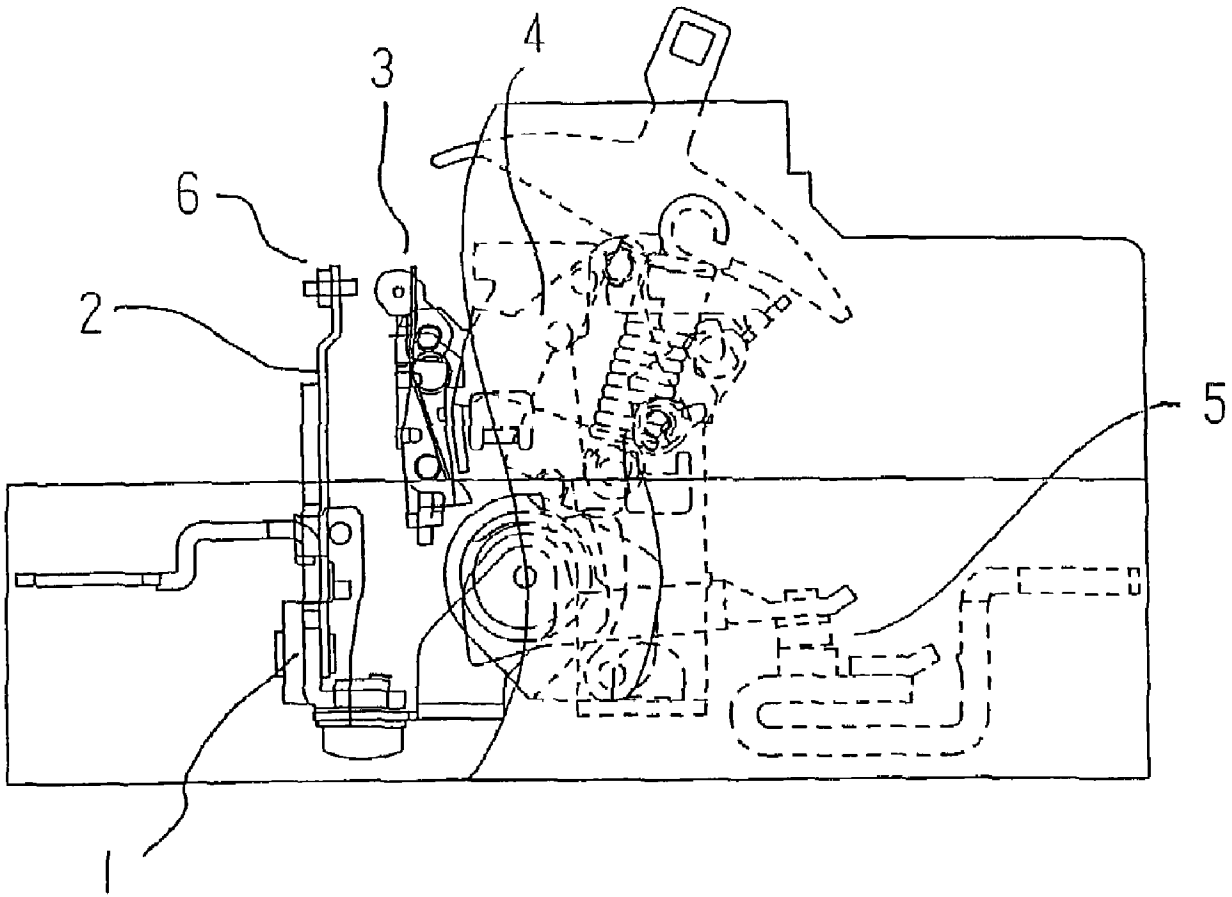
FIG. 9 is a partially cutaway front view showing a structure of a circuit breaker having a thermal trip device.

A circuit breaker is a safety device that interrupts a circuit to prevent accident when overcurrent which is not lower than rating flows. A mechanism that detects overcurrent in the circuit breaker, is referred to as a trip mechanism; and as one of detecting means thereof, there is a thermal type using a bimetal. This is one, which uses a property that the bimetal curves depending on temperature change. FIG. 9 is a thermal trip mechanism and, more specifically, is a partially cutaway front view showing a structure of a circuit breaker having a thermal trip device.

Operation when overcurrent which is not lower than rating current flows is as follows.

(1) Overcurrent flows in a heater 1 or a bimetal 2, thereby increasing temperature of the heater 1 or the bimetal 2.

(2) With the temperature increase of the bimetal 2, the bimetal 2 curves.

(3) An amount of curvature of the bimetal 2 increases to press a trip bar 3.

(4) A mechanical section 4 actuates to instantaneously interrupt a main circuit 5 (trip).

The range of a time from when the overcurrent flows till the overcurrent trips is stipulated by standard such as JIS and trip time of products must comply with its range. However, an operational point of the trip mechanism, that is, a position where the bimetal 2 presses the trip bar 3 changes due to accumulation in manufacturing variation such as error in processing and assembling and variation in material characteristics of each component constituting the trip mechanism; and variation in a time (trip time) from energization initiation to trip completion is generated. Consequently, in order to absorb such manufacturing variation, an adjustment mechanism 6 is provided at a top end of the bimetal 2 and the trip bar 3 to perform adjustment and inspection work in the assembling step.

In the adjustment and inspection work, trip characteristic for each workpiece needs to be accurately measured. Usually, the trip characteristic is often measured by measuring the trip time by supplying a predetermined current value and by measuring an amount of displacement of the bimetal during that time. However, the trip time and the amount of displacement of the bimetal are largely affected by workpiece temperature at energization initiation and measurement environment temperature; and therefore, the measurement must be performed in a state controlled at a constant temperature or the measurement value must be corrected on the basis of the workpiece temperature and ambient temperature.

Meanwhile, the bimetal is determined by an amount of curvature (an amount of displacement) on the basis of its temperature and a curvature factor; however, the curvature factor is known and therefore the amount of displacement can be determined by measuring the bimetal temperature. Therefore, the trip characteristic can be measured by measuring the bimetal temperature.

In the measurement of the bimetal temperature, a no-contact emission thermometer is commonly used. This is because that when a contact thermometer is used, deflection of the bimetal is generated due to contact load of a probe to change trip characteristic, so that accurate trip characteristic cannot be measured.

The no-contact thermometer measures an object's temperature by detecting an amount of emission energy of infrared rays emitted from the object. An amount of infrared radiation differs depending on a material and a surface state; and an amount of emitted infrared energy (emissivity) is different even at the same temperature. The no-contact thermometer calculates temperature on the basis of an ideal black body (theoretical body of emissivity 100%) and an object other than that must be corrected in accordance with each emissivity.

The emissivity can be usually obtained on a trial basis. Since it is difficult to determine emissivity of a measured object in a short time, the emissivity cannot be determined for each workpiece in the mass production step. Therefore, in the case where the emissivity of the bimetal varies, its variation becomes variation of temperature measurement. Further, the bimetallic surface is usually a metallic luster surface and therefore infrared rays emitted from other heat source in the vicinity of the bimetal such as a heater or the like are easy to be reflected on the bimetallic surface. If the reflected light enters into an emission thermometer, it causes measurement error.

Furthermore, temperature measurement is possible by correcting depending on the emissivity even in the case where the emissivity is low; however, an absolute amount of the infrared rays reduces and therefore noise components in measuring increase to cause accuracy degradation in the temperature measurement. Consequently, it is preferable that the emissivity is high and constant for highly accurate temperature measurement.

Figure 1:
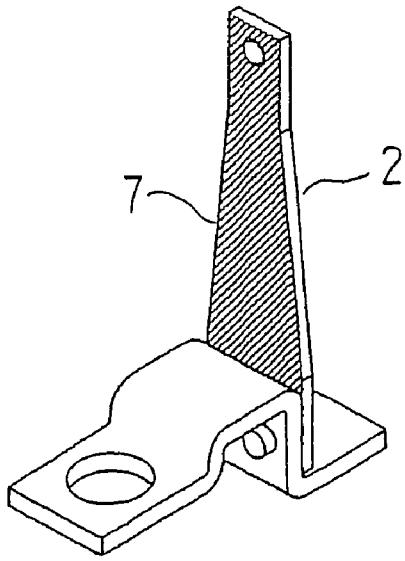
FIG. 1 is a perspective view showing a bimetal part of a thermal trip device according to a first embodiment of the present invention.

Consequently, in the present invention, the surface serving as a temperature measurement part of the bimetal 2 is made to be black, preferably matte black 7 (refer to FIG. 1), thereby increasing the emissivity and being constant. This makes even a different workpiece a constant high emissivity and therefore the bimetal temperature can be highly accurately and stably measured. Furthermore, reflection from other heat source can be suppressed by a matte coating and measurement error can be reduced. FIG. 1 is a perspective view showing a bimetal part of a thermal trip device according to a first embodiment of the present invention. In order to make black, for example, there is a method such as coating and etching. In order to make matte black, matte black coating may be used. Furthermore, it may make matte black by oxidizing together with etching. In this case, as for etching solution, for example, sodium hydroxide solution and phosphate solution are used when the bimetal 2 is an iron group material; and, for example, acid aqueous solution containing selenium is used when it is a copper group material.

Second Embodiment

Figure 2:
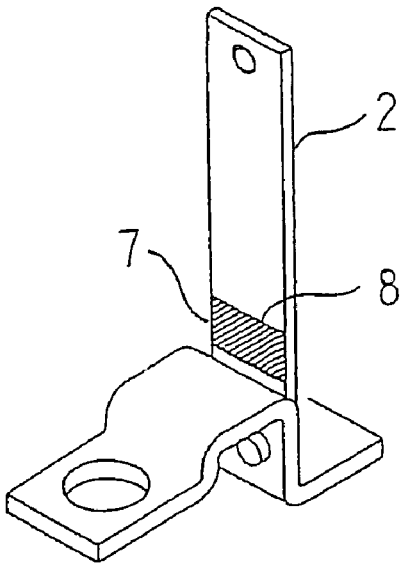
FIG. 2 is a perspective view showing a bimetal part of a thermal trip device according to a second embodiment.

In order to highly accurately measure a bimetal temperature; a temperature measurement position in a bimetal, that is, a temperature measurement part 8 (refer to FIG. 2) needs to be fixed. This is because a temperature distribution exists in a bimetal 2, for it is difficult to uniformly heat the entire bimetal in heating the bimetal 2 by a heater. Therefore, blackening process of the surface of the bimetal 2 described in the first embodiment may be applied to the temperature measurement part. FIG. 2 is a perspective view showing a bimetal part of a thermal trip device according to a second embodiment.

Figure 5:
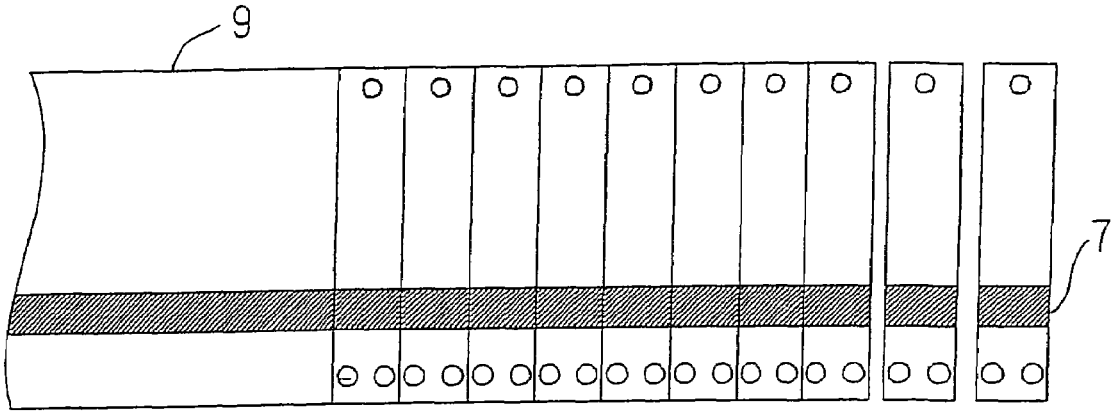
FIG. 5 is a plan view showing a material processing step of the bimetal according to the second embodiment.

Usually, the bimetal 2 for use in a circuit breaker is manufactured by press working from an elongate bimetallic material 9 (refer to FIG. 5). Therefore, only a part to be the temperature measurement part in a step of the material 9 is made to be black, preferably matte black 7; and by performing press working on it, a bimetallic strip in which only a necessary part is blackened can be obtained. FIG. 5 is a plan view showing a material processing step of the bimetal according to the second embodiment. Blackening process performed in a state of the bimetallic strip is more simplified and reduced in processing cost than blackening process performed in a state of the material in block. Furthermore, minimizing the processing part as in the second embodiment can further reduce processing cost.

Third Embodiment

Figure 3:
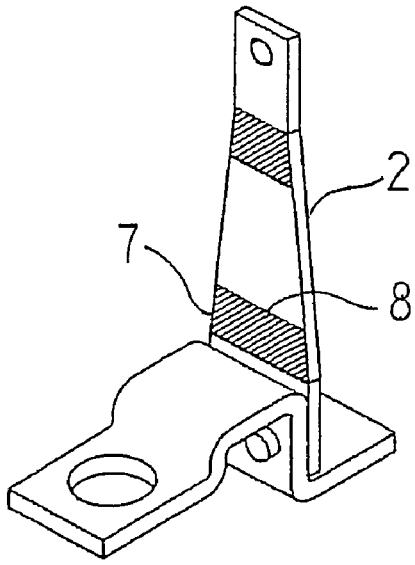
FIG. 3 is a perspective view showing a bimetal part of a thermal trip device according to a third embodiment.
Figure 6:
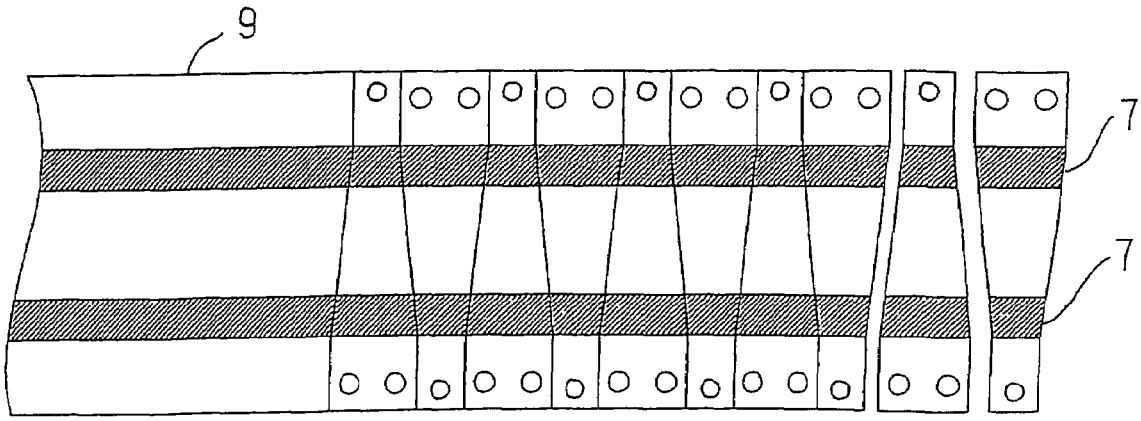
FIG. 6 is a plan view showing a material processing step of the bimetal according to the third embodiment.

An example where two black parts are provided on a bimetallic material 9 is shown in FIG. 6. There is a bimetal shape that gradually narrows toward a top end; and in this case, orientation of bimetallic strips is alternatively combined and press worked, whereby yield of the material 9 can be increased. The bimetallic material 9 drawn out from a rolled material is provided with two black parts and press worked as shown in the drawing. A perspective view of a principal part of a thermal trip device using the bimetal formed in a third embodiment is shown in FIG. 3.

Fourth Embodiment

Figure 7:
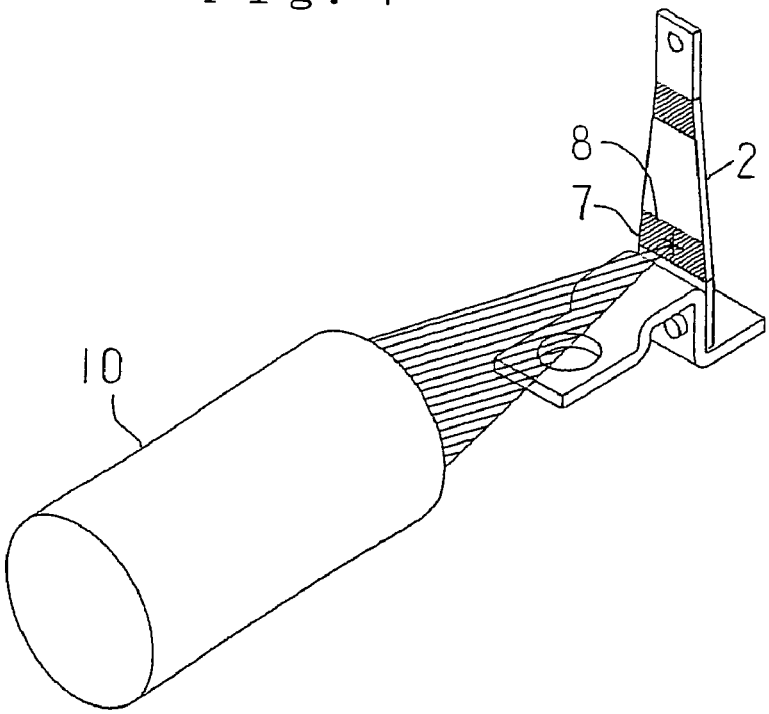
FIG. 7 is a view showing a state where temperature of the bimetal of the third embodiment is measured using a no-contact thermometer.

In order to measure a bimetal temperature using a no-contact thermometer, the thermometer is installed substantially perpendicular to a temperature measurement part 8 of the bimetal and no obstacle which blocks infrared rays needs to be existed therebetween. FIG. 7 is a view showing a state where the bimetal 2 of the third embodiment is measured using a no-contact thermometer 10.

However, for example, an electric leakage detection section is incorporated in an electric leakage circuit breaker adjacent to the bimetal and there are many cases where the above-mentioned space cannot be secured. Furthermore, in also a circuit breaker, points that can measure a bimetal temperature are limited due to downsizing of the product and there is a case where it is impossible to measure ideal temperature measurement points on the bimetal. A fourth embodiment is possible to perform temperature measurement at desired points even in such a case.

Figure 4:
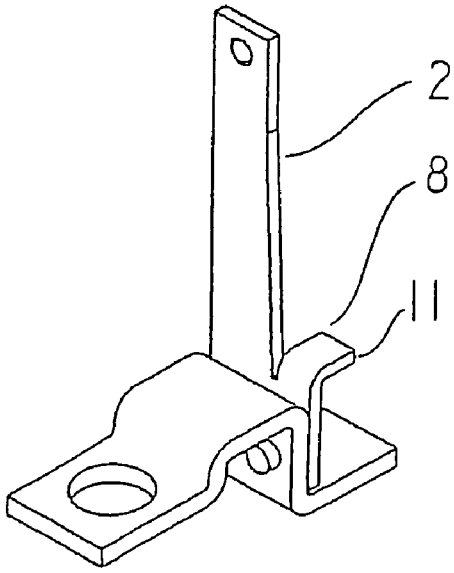
FIG. 4 is a perspective view showing a bimetal part of a thermal trip device according to a fourth embodiment.

A perspective view of a bimetal part of a thermal trip device according to a fourth embodiment is shown in FIG. 4. A bending part 11 is provided at a point serving as a temperature measurement part 8 of the bimetal.

Figure 8:
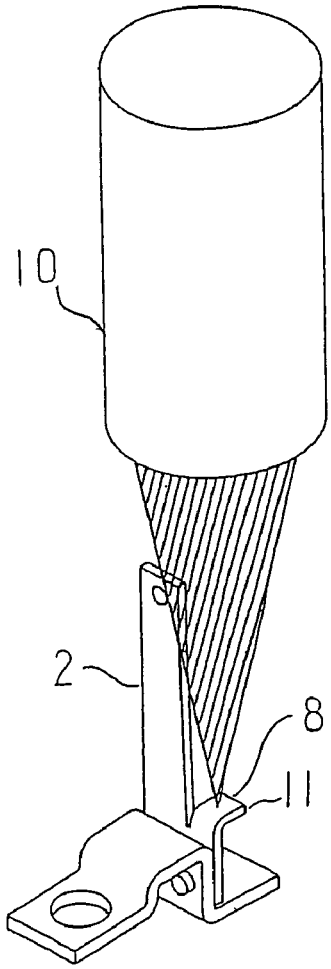
FIG. 8 is a view showing a state where temperature of the bimetal of the third embodiment is measured using a no-contact thermometer.

As shown in FIG. 8, a bending part 11 is provided substantially perpendicular to longitudinal direction of the bimetal 2 at the temperature measurement part 8 of the bimetal so as to measure temperature from the longitudinal direction of the bimetal. In the thermal trip device, a measurable space is often provided in the longitudinal direction of the bimetal 2 because it is necessary to have a space for bending the bimetal 2 and to adjust trip characteristic. However, it is very difficult to measure temperature, because in a conventional bimetal, only a measurable space as much as thickness is provided from this direction.

Consequently, bending process is applied to a part which is the temperature measurement part 8 of the bimetal 2 to provide a bending part 11 so as to secure an area necessary for temperature measurement, whereby it is possible to measure temperature from upper side by a no-contact thermometer 10 parallel to a longitudinal direction of the bimetal 2, as shown in FIG. 8. It is possible to measure temperature at any location of the bimetal by changing a position to which the bending process is applied.

Further, if a part where temperature measurement is performed at the surface of the bending part is made to be black, preferably matte black, after the bending process or before the bending process; it is possible to further highly accurately measure the bimetal temperature.

INDUSTRIAL APPLICABILITY

As described above, a thermal trip device according to the present invention become possible to highly accurately measure bimetal temperature using a no-contact thermometer and therefore an amount of displacement of the bimetal can be precisely determined; this device is suitably applied to a circuit breaker; and characteristic of the circuit breaker can be easily stabled.

The invention claimed is:

1. A thermal trip device in which a bimetal is heated by overcurrent and performs trip operation of a circuit by curvature of said heated bimetal, wherein a temperature measurement part of said bimetal is provided with a bending part bent substantially perpendicular to a longitudinal direction of said bimetal, and the surface of said bending part is made to be black.

2. The thermal trip device according to claim 1, wherein the surface of said bending part is made to be matte black.

3. A circuit breaker having a thermal trip device in which a bimetal is heated by overcurrent and performs trip operation of a circuit by curvature of said heated bimetal, wherein a temperature measurement part of said bimetal is provided with a bending part bent substantially perpendicular to a longitudinal direction of said bimetal, and the surface of said bending part is made to be black.

* * * * *